United States Patent [19]

Cheng

[11] 4,231,123

[45] Nov. 4, 1980

[54] ENAMELLED BASIN STRUCTURE

[76] Inventor: Yao-Hui Cheng, No. 1, Alley 1, lane 774 Kuo Hwa St., Chiyi, Taiwan

[21] Appl. No.: 974,114

[22] Filed: Dec. 28, 1978

[51] Int. Cl.[3] ..... A47K 1/04; E03C 1/18

[52] U.S. Cl. ..... 4/651; 4/519; 4/553; 4/591; 4/626

[58] Field of Search ..... 4/187 R, 189, 150, 181, 4/166, 167

[56] References Cited

U.S. PATENT DOCUMENTS

| | | | |
|---|---|---|---|
| 1,426,046 | 8/1922 | Cohen | 4/150 UX |
| 1,677,160 | 7/1928 | Woolfenden | 4/150 |
| 2,198,631 | 4/1940 | More | 4/150 |
| 2,679,652 | 6/1954 | Eyring | 4/181 |
| 2,812,518 | 11/1957 | O'Brien et al. | 4/181 UX |
| 2,993,213 | 7/1961 | Carroll | 4/181 |
| 3,579,667 | 5/1971 | Giglio | 4/181 |
| 3,967,323 | 7/1976 | Serio | 4/181 X |

*Primary Examiner*—Henry K. Artis
*Attorney, Agent, or Firm*—Holman & Stern

[57] ABSTRACT

This invention relates to water basins and valves and valve controls therefore. The basin has interior water supply and overflow lines communicating with the interior peripheral surface and is provided with valves and push button controls to control the flow of water into and out of the basin.

6 Claims, 5 Drawing Figures

ENAMELLED BASIN STRUCTURE

BRIEF SUMMARY OF THE INVENTION

This invention relates to improvements of enamelled basins or the like including push buttons to control the flow of water into or out of the basin without the use of screw type valves. The invention also includes feeding water through the interior periphery of the basin and overflow control through the interior periphery.

One of the objects of the invention is to avoid accidentally hitting the faucet because the faucet is exposed.

Another object of the invention is to supply water into the basin uniformly, without noise and splash.

Another object of the invention is to provide a push button valve control for the basin drain.

Another object of the invention is to provide a push button valve control having three step grooves which control quantity and temperature of the water supplied to the basin.

BRIEF DESCRIPTION OF THE SEVERAL VIEWS OF THE DRAWING

The present invention will now be described with greater clarity and specificity with reference to the following drawings, in which.

DETAILED DESCRIPTION

Figure 1:
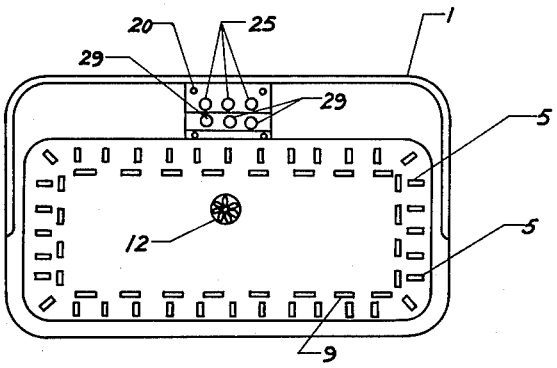
FIG. 1 is a top view of the basin.
Figure 2:
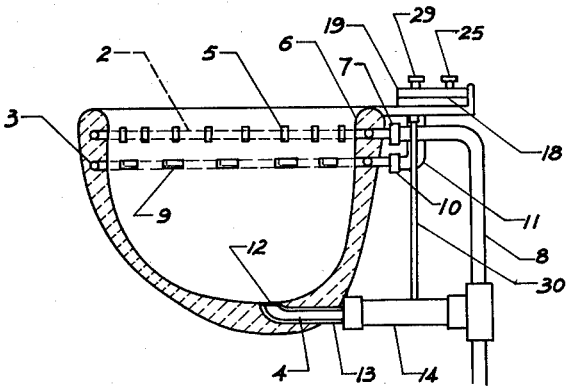
FIG. 2 is a side cross-sectional view of FIG. 1.
Figure 3:
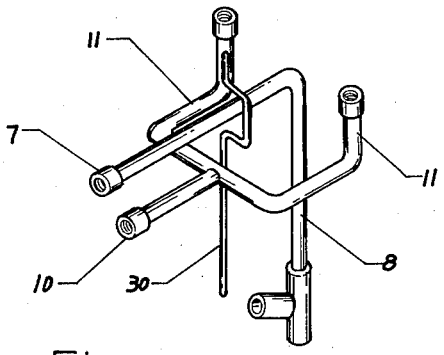
FIG. 3 is a perspective view of the tube connecting system.

Referring to FIGS. 1 and 2, there is shown the basin 1 having a drainage passage 2 and rectangular holes 5 on its interior periphery surface communicating with passage 2. These rectangular holes 5 and drain passage 2 allow excess water to flow out of the basin to prevent overflow. The drainage passage 2 connects with the drain pipe 8 by means of nut 7. Below the drainage passage 2 is also provided an entry passage 3 and rectangular holes 9 communicating therewith on the interior periphery surface of the basin 1. The entry passage 3 connects with entry pipe 11 by means of nut 10. Entry pipe 11 is of course connected in any well known manner to a source of hot and cold water and for this purpose may be a double line merging into a single line through a T-section, such as shown in FIG. 3, for example, The basin 1 has a basin stopper 12 at its bottom in order to avoid objects falling into and blocking, the basin drain pipe 4 which is connected with the valve body 14 by a nut. The drainpipe 8, as shown in FIG. 2, is a cylindrical pipe which is connected with drain passage 2 through tube 6 by nut 7, and connected with the valve body 14 by a three-direction joint, or T-joint.

Figure 4:
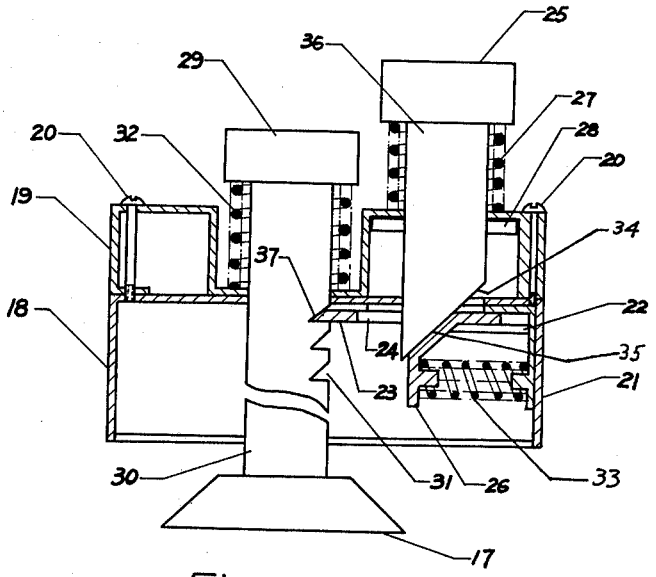
FIG. 4 is a cross-sectional view of the front and rear controlled buttons.

The valve and push button valve controls of this invention can readily be understood by reference to FIGS. 2 and 4. In FIG. 2 the valve 14 is shown in use as a drain valve, but it is to be understood the valve operates in the same manner when used in the hot and cold water feed lines.

Figure 5:
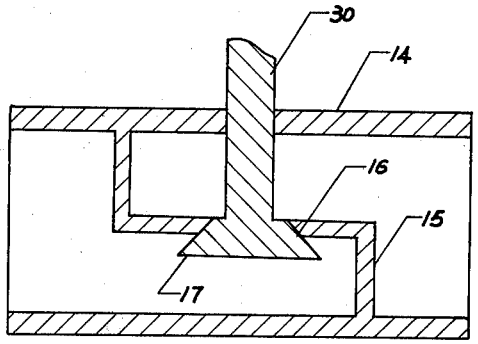
FIG. 5 is a cross-sectional view of the vavle body.

The valve body 14, as shown in FIG. 5, is made by molding. The interior surface of valve 14 is formed with a partition 15, which has a taper hole (valve seat) 16 that cooperates with the tapered surface of the flow of valve 17 so as to control the water by means of the button 29 at the upper end of the valve stem 30 (FIGS. 2 and 4). The valve body 14 has external threads on each end for connecting with other pipes by means of nuts.

The front button 29, as shown in FIG. 4, has a bottom cover 18 which is fixed on the basin 1 and through which valve stem 30 extends. A top cover 19 is attached to bottom cover 18 by screws 20.

The push button controls are best shown in FIG. 4. A front button 29 is provided on the top of valve stem 30 which extends through and above a housing or cover assembly 18, 19. Bottom cover 18 is attached by ordinary means to the basin 1. Top cover 19 is attached to bottom cover 18 by screws 20, or the like. Both covers 18 and 19 have aligned apertures to accomodate free linear movement of valve stem 30 therethrough. Coil spring member 32 is provided around valve stem 30 between the bottom of button 29 and the top of a recessed portion in top cover 19 to resiliently urge the valve stem upwardly, thereby closing the valve 17. Thus, by depressing button 29 against the force of spring 32, the valve may be opened. The valve may be held open in various positions to control the flow of water by rear button 25 which has a rod like extension 36 extending substantially vertically from its lower surface through aligned apertures in top and bottom covers 19 and 18 respectively. Coil spring 27 is provided between the bottom of button 25 and the top surface of top cover 19 to urge button 25 upwardly. A retaining member 28 is attached to the lower extension of button 25 between the top surface of bottom cover 18 and the bottom surface of top cover 19 to retain button 25 in its uppermost position against the action of spring 27. Retaining member 28 reciprocates in and is guided by the side walls of a hollow portion of top cover 19. The lower end of the extension 36 on button 25 has an inclined camming face 34 which mates with an inclined face 35 on cam follower 26. Follower 26 has an integral slide plate 23 which supports it for sliding movement in guide grooves 22 in guide plate 21 attached to the inside wall of bottom cover 18 and is spring urged, by coil spring 33 into engagement with the cam face 34. Slide plate 23 has an aperture 24 to accomodate free movement of the button extension and cam face therethrough and has an inclined top face at its outer end 37 which engages in stepped grooves or notches 31 in valve stem 30. Each notch has an inclined top face mating with the inclined face of slide plate 23 and a second lower substantially horizontal face so that the slide plate 23 when engaged in one of the notches holds the valve 17 in fixed position.

In operation, with the valve closed, depressing button 29 will open valve 17 and slide plate 23 will engage in one of the notches 31 to hold the valve in the open position selected. The inclined top face of each notch acts as a camming surface on the inclined top face on the end 37 of slide plate 23 so that further depressing of push button 29 will move slide plate 23 to the right and out of locking position in the notch. In this way the push-button 29 selectively controls the open position of the valve desired and thereby the flow through the valve. When it is desired to shut off the flow of water, one merely depresses button 25 which through the action of the cam face 34 on the cam follower moves follower 26 and the integral slide plate 23 to the right retracting the slide plate 23 from notch 31, whereupon spring 32 returns the button 29 and associated valve 17 to the closed position.

As previously stated, it is intended that the valve and push button system described be installed in the hot and cold water lines, although this is not entirely shown. For example, FIG. 1 shows three pairs of front and rear push buttons for the basin 1. The buttons to the left and right are for the hot and cold water lines. The center buttons control the drain at the bottom of the basin as shown in FIG. 2. The hot and cold buttons can be operated independently, or at the same time to control the amount of flow in each line and thus the temperature of the water entering the basin.

What I claim is:

1. An enamelled bowl shaped basin having a drain at the bottom connected to a drain line and a continuous external supply of water comprising a first passageway integrally enclosed within the rim portion of the basin connected to the external water supply, a first row of holes spaced around the inside of said basin near the rim communicating with said first passageway, a second passageway integrally enclosed within the rim portion of the basin connected to the drain line, a second row of holes spaced around the inside of said basin above said first row of holes and communicating with said second passageway, at least one water supply line connected to said first passageway, valve means in said water supply line for controlling the flow of water therein, and push button means connected to said valve means for selectively positioning the valve means.

2. The basin structure as claimed in claim 1 and further comprising a second valve means in the drain line leading from the bottom drain, a second push button means connected to the second valve means for selectively positioning the second valve means.

3. The basin structure as claimed in either claims 1 or 2 wherein the first and second valve and push button means are the same structure, the valve means comprising a hollow valve body, a partition in said valve body, a valve opening in said partition, a valve member for opening and closing said opening having a valve stem on said valve extending through said valve body, said push button control means comprising a hollow cover member adapted to be mounted in fixed position, an aperture in said cover member through which said valve stem extends, a first push button on the end of said valve stem, a spring between the cover and first push button for resiliently urging said push button and valve stem in a direction to close the valve, and means for releasably retaining said first push button and valve selectively in various positions.

4. The basin structure as claimed in claim 3 wherein the releasable retaining means comprises, a plurality of notches linearly spaced on the valve stem within said cover, a plate member slidingly mounted on guide grooves within the cover member having its inner edge shaped to engage one of said notches, a spring means urging said plate member into engagement with said notches to lock the valve in position, and release means to withdraw the plate member against the force of said spring from said notch to release the valve.

5. The basin structure as claimed in claim 4 wherein the release means comprises a second push button adjacent said first push button and having a rod-like extension extending from its lower surface through an aperture in said cover member, a spring between said cover and second push button to urge said second push button away from said cover, a flange on said extension within said cover member to retain said second push button, a cam surface on the other end of said extension within said cover member, a cam follower integral with the slide plate and engaging said cam surface so that depressing the second push botton will cause the cam surface to slide the plate member out of engagement with said notch to release the valve.

6. The basin structure as claimed in claim 5 and further comprising hot and cold water lines in the water supply, said valve member being provided in each line and a push button control means for each valve mounted adjacent to each other at the upper rim of the basin.

* * * * *